United States Patent [19]

Ferren et al.

[11] Patent Number: 4,827,387

[45] Date of Patent: May 2, 1989

[54] TWO-AXIS BEAM STEERING SYSTEM FOR USE IN AUTOMATED LIGHT FIXTURES

[75] Inventors: Bran Ferren, East Hampton, N.Y.; Charles F. Harrison, Adelphia, Md.; Clinton B. Hope, Southampton; Robert J. Kohut, Sag Harbor, both of N.Y.

[73] Assignee: Strand Lighting, Inc., Rancho Dominguez, Calif.

[21] Appl. No.: 201,486

[22] Filed: Jun. 1, 1988

[51] Int. Cl.[4] ..... F21V 7/05

[52] U.S. Cl. ..... 362/284; 362/277; 362/301

[58] Field of Search ..... 362/277, 282, 283, 284, 362/286, 287, 297, 298, 301, 346; 350/618

[56] References Cited

U.S. PATENT DOCUMENTS 4,663,698 5/1987 Tomlinson ..... 362/284 X 4,769,743 9/1988 Callahan ..... 362/284 X

*Primary Examiner*—Stephen F. Husar

*Attorney, Agent, or Firm*—Noel F. Heal

[57] ABSTRACT

A beam steering mechanism for deflecting a light beam along any selected azimuth and elevational direction. The beam is movable without limitation about a pan axis and about a tilt axis, by drive motors that are rigidly mounted to a housing and are not bodily moved with the light beam. Movement about the pan axis is effected by rotation of a first mirror mounted in a first rotatable cylinder. Movement about the tilt axis is effected by rotation of a second mirror mounted in a second cylinder that is panned with the first cylinder and is itself mounted for rotation about the tilt axis.

11 Claims, 4 Drawing Sheets

TWO-AXIS BEAM STEERING SYSTEM FOR USE IN AUTOMATED LIGHT FIXTURES

BACKGROUND OF THE INVENTION

This invention relates generally to illumination devices used in the entertainment field and, more specifically, to lighting fixtures emitting a controllably steered light beam. Ideally, the light beam must be continuously steerable through a full circle, i.e. 360 degrees of azimuth angle, and through a full 360 degrees of elevation, from horizontal to vertical in both directions.

In the past, two-axis beam steering has been accomplished either by turning an entire fixture or lamp housing, or by use of a single mirror. Movement of the entire fixture limits the positioning speed because of the relatively high inertia of the fixture. Also, movement of the lamp results in lower lamp life because of motor vibration and continual movement. Such devices also have angular limits on the extent of movement of the beam about the azimuth and elevation axes.

Some of these difficulties are diminished by the use of a mirror to steer the beam, as disclosed in U.S. Pat. No. 4,697,227 to Callahan. In the Callahan device, a light beam is deflected through a ninety-degree angle by a plane mirror oriented at 45 degrees to the optical axis of the beam. A motor rotates the mirror about the optical axis, to deflect the beam to any azimuth angle in a plane perpendicular to the optical axis. Deflection in elevation is achieved by rotation of the entire fixture assembly about an axis perpendicular to the optical axis. Therefore, although steering about one axis is relatively quick and responsive, steering about the other axis is subject to inertia limitations and to angular movement limitations imposed by having motors that must be bodily moved to steer the beam.

Ideally, a two-axis beam steering system should be able to deflect a light beam through a solid angle equivalent to a complete sphere, without angular limitations except for any dead zone or shadowing caused by the presence of system components. Furthermore, steering of the beam should be accomplished without bodily movement of drive motors or other bulky components. The present invention is directed to these ends.

SUMMARY OF THE INVENTION

The present invention resides in a beam steering system that directs a light beam from a light source, using two mirrors that are rotatable to provide beam steering about azimuth and elevation axes. The mirrors are driven by motors that are mounted in a fixed relationship to the light source and are not bodily moved when the beam is steered. Since the mirrors and associated drive mechanisms are of relatively small inertia, beam positioning can be effected very quickly, and no limitations are imposed on the angular movements of the beam by having to move the motors bodily with the beam.

Briefly, and in general terms, the invention comprises an assembly housing, a light source for directing a controllable beam of light along a first axis, a first mirror means, a second mirror means and first and second drive means. The first mirror means is mounted in the path of the light beam, is rotatable about the first axis, and is oriented to deflect the beam through an angle and along a second axis that is rotatable about the first axis with the first mirror means. The second mirror means is mounted in the path of the light beam in the second axis, and is rotatable about the second axis, to deflect the beam along a final path of which the direction is controllable by rotation of the two mirror means about the first and second axes. The first and second drive means includes first and second drive motors mounted rigidly on the assembly housing, for effecting angular movement of the first and second mirror means about the first and second axes, respectively. Rapid and accurately controllable movements of the light beam can be obtained without bodily movements of the drive motors.

More specifically, the first mirror means includes a first hollow body mounted for rotational movement on the housing, a first drive pulley rigidly connected to the first hollow body, and a mirror mounted within the first hollow body to deflect the light beam out of the body and along the second axis. The second mirror means includes a second hollow body mounted for rotation on the first hollow body for rotation about the second axis, a second drive pulley rigidly connected to the second hollow body, and a second mirror mounted in the second hollow body and positioned to deflect the light beam out of the body and along a desired final direction. The first drive means includes a first-axis drive belt coupling the first drive motor to the first drive pulley, and the second drive means includes means for coupling the second drive motor to the second drive pulley.

In the illustrative embodiment of the invention, the means for coupling the second drive motor to the second drive pulley includes two rigidly connected drive pulleys mounted for free rotation about the first axis, a second drive belt coupling the second drive motor to one of the two rigidily connected drive pulleys, a pair of idler pulleys mounted for rotation on the first hollow body about an axis approximately perpendicular to both the first and second axes, and a third drive belt extending about the second of the two rigidly connected drive pulleys, about the two idler pulleys and about the second drive pulley on the second hollow body. The second drive motor drives the rigidly connected drive pulleys with the second drive belt, and torque is then transmitted from the rigidly connected drive pulleys to the second hollow body through the third drive belt, but without bodily movement of any of the drive motors.

It will be appreciated from the foregoing that the present invention represents a significant advance in the field of steerable light beams. In particular, the invention provides a technique for rapidly moving a light beam without the inertia and other problems associated with moving an entire light fixture or bodily moving a drive motor. In the present invention, a light beam can be rotated about a pan axis through 360 degrees or more without limitation, and can be simultaneously or separately rotated about a tilt axis through a range of 360 degrees, limited only by a possible tilt-axis dead-zone due to the necessary presence of opaque components of the system. Other aspects and advantages of the invention will become apparent from the following more detailed description, taken in conjunction with the accompanying drawings.

DESCRIPTION OF THE PREFERRED EMBODIMENT

Figure 1:
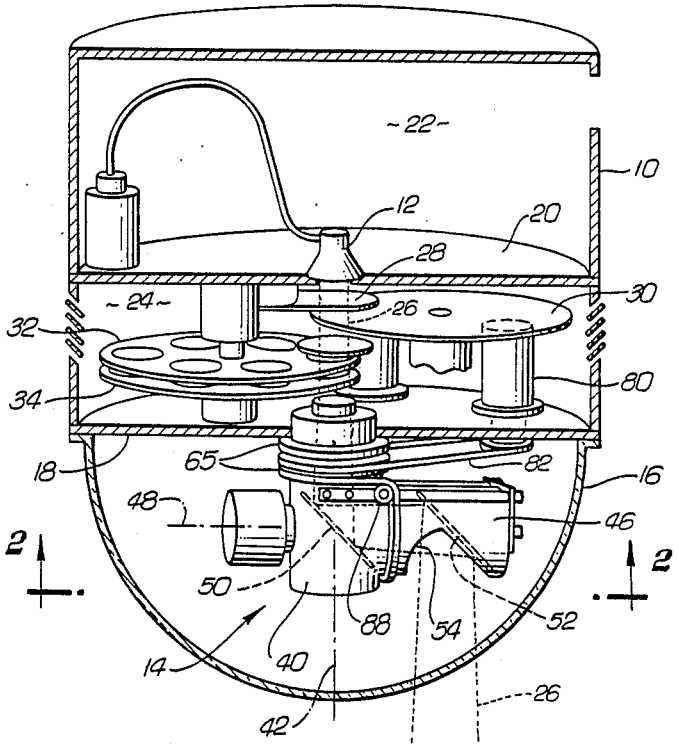
FIG. 1 is an elevational perspective view of a complete lighting fixture, with its outer covering partly broken away for purposes of illustration, and employing the beam steering mechanism of the present invention.
Figure 2:
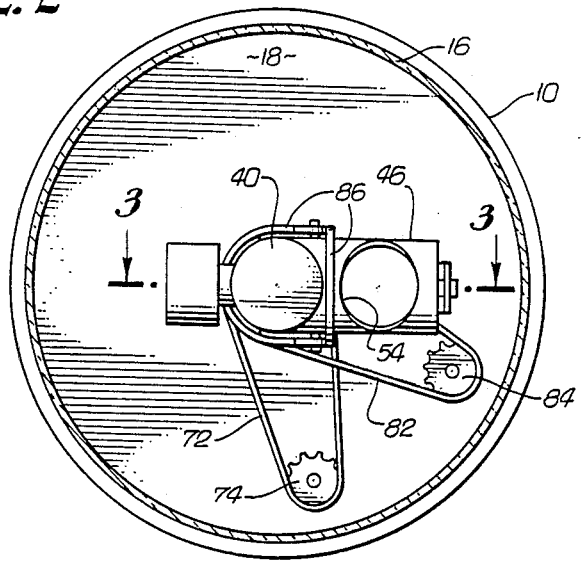
FIG. 2 is a bottom plan view of the fixture of FIG. 1, showing portions of the beam steering assembly.

As shown in the drawings for purposes of illustration, the present invention is directed to a two-axis light beam steering system. In the past, such systems have required that at least one drive motor be bodily moved when the beam is rotated about one axis. Older systems have required that an entire light fixture assembly be rotated with the beam.

In accordance with the present invention, a light beam is successively deflected from two mirrors, which are rotatable to produce beam rotation about two mutually perpendicular axes. For convenience of description, these are referred to as the pan axis and the tilt axis, but it will be appreciated that these terms are not intended to be limiting, and that the invention to be described is capable of deflecting a light beam about any two mutually perpendicular axes. For convenience, the invention will be described as being oriented such that the beam may be deflected to point in any direction or azimuth angle with respect to a vertical axis, and may be simultaneously deflected to any elevational angle.

FIG. 1 shows a complete lighting fixture employing the beam steering technique of the invention. The fixture includes a housing, indicated by reference numeral 10, containing a lamp 12 and various optical components for conditioning the light beam, and a beam steering assembly 14 mounted on the housing and covered by a transparent hemispherical dome 16 secured to the housing. The housing is typically mounted on a rigid overhead pipe or other structure, in the orientation in which it is illustrated. The housing 10 includes a bottom cover plate 18 on which the beam steering assembly 14 and various other components are mounted, and an intermediate mounting plate 20 that divides the housing into upper and lower portions 22 and 24. The lamp 12 is mounted on the intermediate mounting plate 20 and is contained in the upper portion 22 of the housing 10. The lamp 12, which need not necessarily be oriented exactly as shown, produces a substantially vertical beam 26, which passes through an opening in the mounting plate 20, and into the lower portion 24 of the housing 10.

The beam 26 then passes through conventional optical elements in the lower portion 24 of the housing, including a douser 28, a gobo wheel 30, a multimesh wheel 32, and a color wheel 34, before reaching the beam steering assembly 14, with which the present invention is concerned. The assembly 14 includes a first hollow cylinder 40 journaled on the lower mounting plate 18 for rotation about a vertical axis 42, referred to as the pan axis, and having a circular opening 44 formed in its sidewall. The assembly also includes a second hollow cylinder 46, mounted on the circular opening 44 for rotation about a horizontal axis 48, referred to as the tilt axis.

Figure 3:
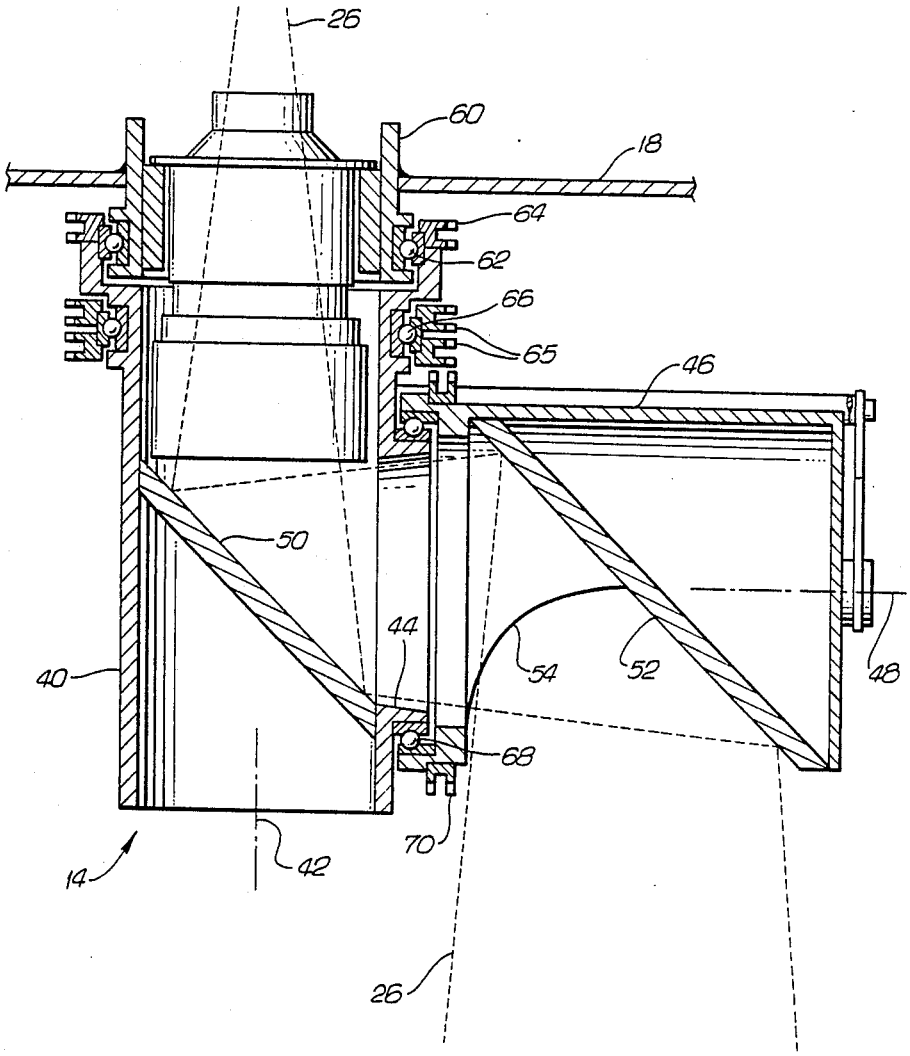
FIG. 3 is an enlarged elevational view, partly in section, of the beam steering mechanism.

As best shown in FIG. 3, the assembly 14 also includes an imaging lens 49, and a first mirror 50 mounted within the first cylinder 40 adjacent to the opening 44, and oriented at forty-five degrees to the pan axis 42. Thus the light beam 26 descending the first hollow cylinder 40 is deflected through ninety degrees by the first mirror 50, and passes through the circular opening 44 and into the second hollow cylinder 46. The second cylinder has a second mirror 52 mounted within it at an orientation of forty-five degrees to the tilt axis 48. The light beam 26 reflects from the surface of the second mirror 52 and passes out of the second cylinder 46 through a large scalloped opening 54 in its sidewall. The drawings show the two mirrors 50 and 52 as being substantially parallel, with the light beam emerging in a vertical direction. However, it will be understood that the second cylinder 46 and the mirror 52 are rotatable about the tilt axis 48, so that the beam may emerge at any desired elevational angle. Moreover, one or both of the mirrors 50 and 52 may be curved as desired to operated in conjunction with the imaging lens 49 in focusing the resulting beam.

It will by now be apparent that positioning of the beam 20 involves rotation of the first cylinder 40 about the pan axis 42 and rotation of the second cylinder 46 about the tilt axis 48. Rotation of the first cylinder 40 carries, i.e. pans, the second cylinder 46 to a new azimuth position. Rotation of the second cylinder 46 effects changes in the elevational angle of the beam in its current azimuth position. These rotational movements are achieved by two drive motors mounted in fixed positions on the housing 10, as now to be described.

FIG. 3 shows some of the necessary drive pulleys used in rotating the beam steering assembly. In particular, the assembly 14 includes a fixed bushing 60 secured to the housing 10, and to which the first cylinder 40 is journaled by means of a bearing assembly 62. This bearing arrangement permits rotation of the first cylinder with respect to the housing 10. Mounted adjacent to the bearing assembly 62 is a pan-axis drive pulley 64, rigidly attached to the first cylinder 40. As will be seen, it is this drive pulley that is used to rotate the first cylinder 40 about the pan axis 42.

Also mounted for rotation about the pan axis 42 is a pair of tilt-axis drive pulleys 65. The pair of pulleys are rigidly coupled together and are journaled for free rotation about the pan axis 42, independently of the first cylinder 40, by means of another bearing assembly 66, located between the bearing assembly 62 and the circular opening 44 in the first cylinder. FIG. 3 also shows yet another bearing assembly 68 by means of which the second cylinder 46 is journaled for rotation in the circular opening 44 in the first cylinder 40. Rotation of the second cylinder 46 is achieved in part by means of a tilt-axis drive pulley 70 rigidly secured to the second cylinder in a position adjacent to the last-mentioned bearing assembly 68.

Figure 4:
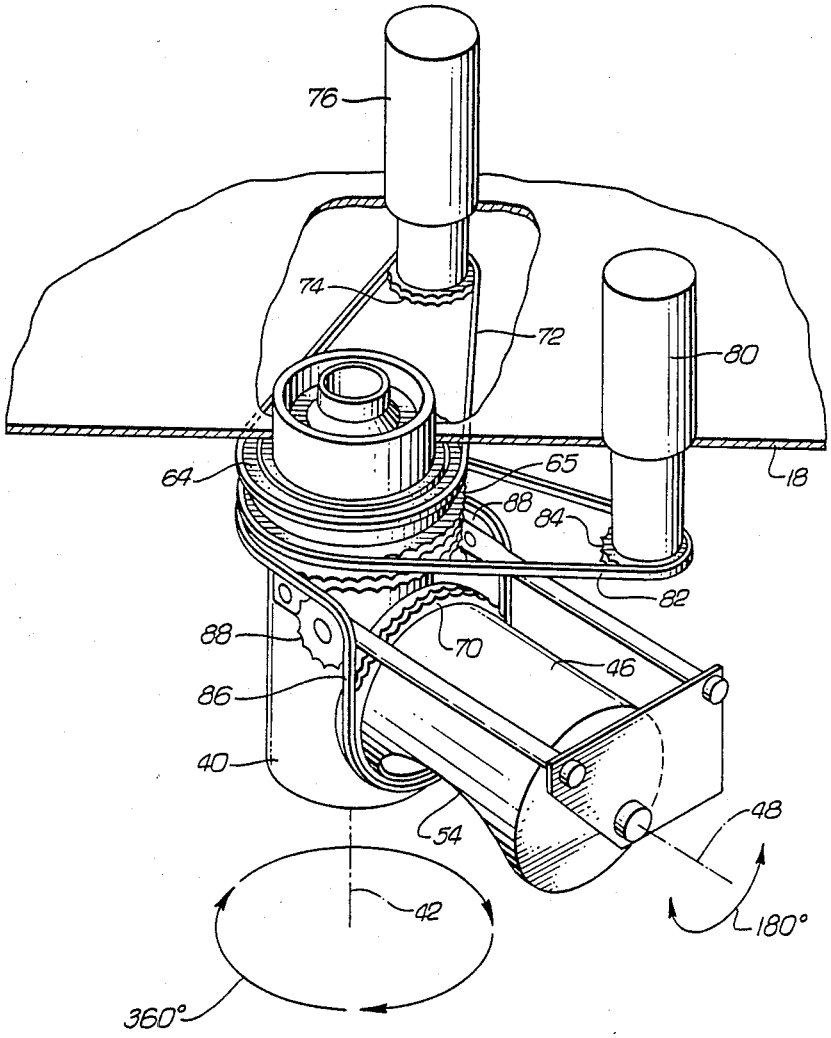
FIG. 4 is a perspective view of the beam steering mechanism of the invention.

Rotation about the pan axis is achieved by means of a single drive belt 72, extending around part of the circumference of the pan-axis drive pulley 64 and, as best shown in FIG. 4, around a pan-axis drive gear 74. The drive gear 74 is mounted on a pan-axis motor 76 rigidly mounted on the bottom mounting plate 18 of the housing 10. Thus, activation of the motor 76 results in rotation of the first cylinder 40 about the pan axis 42.

Rotation about the tilt axis 48 is more difficult to achieve, since the second cylinder 46 moves with the first when there is rotation about the pan axis 42. The conventional, and easiest solution would have been to mount a motor for tilt-axis rotation on the first cylinder 40, but this would mean carrying a drive motor bodily along with the pan-axis movement, with all the inherent disadvantages that this involves. Instead, a fixed tilt-axis drive motor 80 is rigidly mounted on the housing 10, on the same bottom mounting plate 18 as the pan-axis drive motor 76. The tilt-axis drive mechanism includes a first drive belt 82 extending around a tilt-axis drive gear 84 mounted on the tilt-axis drive motor 80, and around one of the pair of tilt-axis drive pulleys 65 that are mounted for free rotation about the pan axis 42. A second tilt-axis drive belt 86 extends around the second of the pair of tilt-axis drive pulleys 65, around a pair of idler pulleys 88 and then around the tilt-axis drive pulley 70 secured to the second cylinder 46. The idler pulleys 88, one of which can be seen in FIG. 1, are mounted for rotation on the first cylinder 40, about an axis perpendicular to both the pan and tilt axes 42, 48.

In effecting movement about the tilt axis 48, the second tilt-axis drive belt 86 has to make a transition through a ninety-degree angle, from pan axis to tilt axis. The idler pulleys 88 are instrumental in making this transition. It will be observed, however, that movements about the two axes are not entirely independent. Consider, for example, what happens if the tilt-axis motor 80 is held angularly fixed while the assembly is driven about the pan axis 42. As the second cylinder 46 and its tilt axis 48 are panned about the pan axis 42, and the second tilt-axis drive belt 86 is held fixed, there is relative movement between the drive belt 86 and the panned-tilt axis 48. In effect, the second cylinder 46 is rolled along the fixed drive belt 86. In other words, a panning motion alone will induce a tilting motion in the second cylinder 46. Accordingly, the two drive motors 76 and 80 must be coordinated to produce a desired combination of pan and tilt motions.

In the illustrative embodiment of the invention, the gear ratio between the pan-axis drive motor 76 and the first cylinder 40 is the same as the gear ratio between the tilt-axis drive motor 80 and the second cylinder 46. To maintain a constant tilt angle for a given angular pan movement, the tilt-axis drive motor 80 must be moved through the same angle as the pan-axis drive motor 76. Stated another way, in order to maintain the tilt angle constant while rotating the device about the pan axis at a given angular velocity, the device must be driven about the tilt axis at the same angular velocity and in the same direction as the pan-axis movement. In order to achieve a desired tilt-axis change in angular position or velocity, it is therefore necessary to add or subtract these movements from the compensating ones described above.

Figure 5:
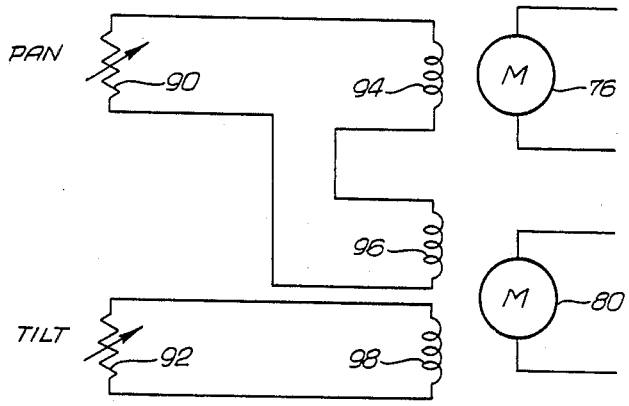
FIG. 5 is a simplified circuit diagram showing one form of control circuitry.

Ideally, movement in the pan and tilt directions should be independently controllable. This independence can be achieved in a variety of ways. In the simplest form of control, two separate analog pan and tilt controls are provided to the operator. The pan control is coupled to both the pan and tilt motors 76 and 80, so that movement of the control from its neutral position moves both motors at equal angular speeds. When a desired pan position is reached, the operator moves the pan control back to its neutral position. At this point in time, both the pan and tilt motors have been moved through equal angles, such that the desired pan position is accomplished with only a compensating movement in the tilt axis. The effect of the tilt control is to add to, or subtract from, the angular movement of the tilt motor, and to effect a tilt-axis rotation independently of the pan axis drive. In a strictly analog environment, the pan-axis and tilt-axis drive motors 76 and 80 may be simple direct-current motors, and the separate controls may be simply rheostats, as shown by way of example in FIG. 5 at 90 and 92.

The pan rheostat 90 is connected via a summing amplifier 93 to both pan and tilt amplifiers 94 and 95. This results in compensating tilt motion for any pan motion. The summing amplifier also adds to, or subtracts from the effect of the pan control position during dual axis motion. The pan and tilt amplifiers 94 and 95 drive the motors 76 and 80. Tachometers 96 and 98 provide feedback signals to the amplifiers 94 and 95, to compensate for differences in friction, inertia and motor characteristics between axes.

A more complex, but versatile approach employs digital circuitry to keep track of the pan and tilt positions of the assembly. The drive motors 76, 80 may then be stepper motors or similar devices responsive to discrete pulses applied to them, to move through a predetermined angular distance for each pulse. For tilt compensation during pan movement, the same number of pulses applied to the pan-axis drive motor 76 is also applied to the tilt-axis drive motor 80. For independent tilt-axis movement, the number of pulses applied to the tilt-axis motor 80 is adjusted up or down to effect a desired angular motion about the tilt axis 48. This form of digital control system can be conveniently coupled to a microprocessor and connected to an operator control console (not shown) in any desired manner. Feedback of the actual pan and tilt positions can be supplied by conventional digital sensors on the first and second cylinders 40, 46. However, the details of such a digital control system are beyond the scope of the present invention, which is concerned only with the mechanics of achieving desired pan and tilt movements without the disadvantages of the prior art.

Figure 6:
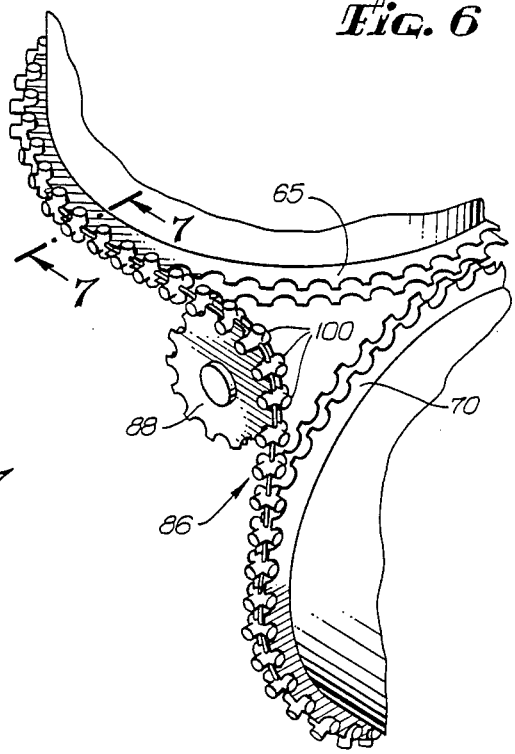
FIG. 6 is a fragmentary perspective view of drive pulleys used in the beam steering mechanism, further enlarged to show drive belt details.
Figure 7:
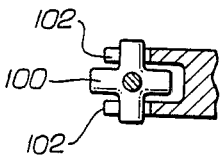
FIG. 7 is a further enlarged cross-sections view taken generally along the line 7—7 in FIG. 6.

FIGS. 6 and 7 show one form of construction that can be employed for the drive belts used in the beam steering assembly 14. The drive belts 82 and 86 are formed from multiple cruciform elements 100 linked together as shown. Each of the drive pulleys 64, 65 and 70, and the idler pulleys 88 are formed to include two parallel flanges 102, which are notched to receive the cruciform elements 100 of the drive belts. Belts of the construction shown can be curved about two perpendicular axes. This permits engagement of drive belt 86 with drive pulleys 65 and 70, as well as idler pulleys 88. Belts 72 and 82 need not be of this cruciform construction. It will be understood that other belt and pulley, or beveled gearing constructions are possible, but the one shown provides a non-slipping drive arrangement that it highly suited to the disclosed embodiment of the invention.

It will be appreciated from the foregoing that the present invention represents a significant advance in the field of lighting control systems for theatrical and similar events. In particular, the beam steering assembly of the present invention is capable of rapid and independently controlled movements about two perpendicular axes, using low-inertia mirrors and drive motors that are rigidly mounted to the device housing. It will also be appreciated that, although an embodiment of the invention has been described in detail for purposes of illustration, various modifications may be made without departing from the spirit and scope of the invention. Accordingly, the invention is not to be limited except as by the appended claims.

We claim:

1. A two-axis light beam steering assembly, comprising:

an assembly housing;

a light source for directing a controllable beam of light along a first axis;

first mirror means, mounted in the path of the light beam, rotatable about the first axis, and oriented to deflect the beam through an angle and along a second axis that is rotatable about the first axis with the first mirror means;

second mirror means, mounted in the path of the light beam in the second axis, and rotatable about the second axis, to deflect the beam along a final path of which the direction is controllable by rotation of the two mirror means about the first and second axes; and first and second drive means, including first and second drive motors mounted rigidly on the assembly housing, for effecting angular movement of the first and second mirror means about the first and second axes, respectively;

whereby rapid and accurately controllable movements of the light beam can be obtained without bodily movements of the drive motors.

2. A two-axis light beam steering assembly as defined in claim 1, wherein:

the first mirror means includes a first hollow body mounted for rotational movement on the housing, a first drive pulley rigidly connected to the first hollow body, and a mirror mounted within the first hollow body to deflect the light beam out of the body and along the second axis;

the second mirror means includes a second hollow body mounted for rotation on the first hollow body for rotation about the second axis, a second drive pulley rigidly connected to the second hollow body, and a second mirror mounted in the second hollow body to deflect the light beam out of the body and along a desired final direction;

the first drive means includes a first-axis drive belt coupling the first drive motor to the first drive pulley; and the second drive means includes means for coupling the second drive motor to the second drive pulley.

3. A two-axis light beam steering assembly as defined in claim 2, wherein the means for coupling the second drive motor to the second drive pulley includes:

two rigidly connected drive pulleys mounted for free rotation about the first axis;

a second drive belt coupling the second drive motor to one of the two rigidly connected drive pulleys;

a pair of idler pulleys mounted for rotation on the first hollow body about an axis approximately perpendicular to both the first and second axes; and a third drive belt extending about the second of the two rigidly connected drive pulleys, about the two idler pulleys and about the second drive pulley on the second hollow body;

wherein the second drive motor drives the rigidly connected drive pulleys with the second drive belt, and torque is transmitted from the rigidly connected drive pulleys to the second hollow body through the third drive belt, but without bodily movement of any of the drive motors.

4. A two-axis light beam steering assembly as defined in claim 3, wherein:

the first hollow body is a first cylinder mounted for rotation about the first axis and having a generally circular opening in its sidewall; and the second hollow body is a second cylinder mounted for rotation in the circular opening in the first cylinder.

5. A two-axis light beam steering assembly as defined in claim 1, and further comprising:

control means coupled to the first and second motors, including means for providing a compensating control signal to the second drive motor, to maintain a desired angular position with respect to the second axis during angular movements about the first axis.

6. A two-axis light beam steering assembly, comprising:

a fixture housing;

a light source for directing a controllable beam of light along a pan axis;

a first hollow body mounted on the housing for rotation about the pan axis, and having a first mirror, positioned in the path of the light beam and oriented to deflect the beam through an angle and along a tilt axis that is panned with rotation of the first mirror;

a second hollow body mounted on the first hollow body for rotation about the tilt axis, and having a second mirror positioned in the path of the light beam along the tilt axis, to deflect the beam along a final path, the direction of which is determined by the angular positions of the first hollow body with respect to an azimuth reference direction and the second hollow body with respect to an elevation reference direction;

first and second drive means, including first and second drive motors mounted rigidly on the assembly housing, for effecting angular movement of the first and second hollow bodies about the pan and tilt axes, respectively;

whereby rapid and accurately controllable movements of the light beam can be obtained without bodily movements of the drive motors.

7. A two-axis light beam steering assembly as defined in claim 6, wherein:

the first drive means includes a first drive pulley rigidly connected to the first hollow body, and a pan-axis drive belt coupling the first drive motor to the first drive pulley; and the second drive means includes a second drive pulley rigidly connected to the second hollow body, and means for coupling the second drive motor to the second drive pulley.

8. A two-axis light beam steering assembly as defined in claim 7, wherein the means for coupling the second drive motor to the second drive pulley includes:

two rigidly connected drive pulleys mounted for free rotation about the pan axis;

a second drive belt coupling the second drive motor to one of the two rigidly connected drive pulleys;

a pair of idler pulleys mounted for rotation on the first hollow body about an axis approximately perpendicular to both the pan and tilt axes; and a third drive belt extending about the second of the two rigidly connected drive pulleys, about the two idler pulleys and about the second drive pulley on the second hollow body;

wherein the second drive motor drives the rigidly connected drive pulleys with the second drive belt, and torque is transmitted from the rigidly connected drive pulleys to the second hollow body through the third drive belt, but without bodily movement of any of the drive motors.

9. A two-axis light beam steering assembly as defined in claim 8, wherein:

the first hollow body is a first cylinder mounted for rotation about the pan axis and having a generally circular opening in its sidewall; and the second hollow body is a second cylinder mounted for rotation in the circular opening in the first cylinder.

10. A two-axis light beam steering assembly as defined in claim 6, and further comprising:

control means coupled to the first and second motors, including means for providing a compensating control signal to the second drive motor, to maintain a desired angular position with respect to the tilt axis during angular movements about the pan axis.

11. A two-axis light beam steering assembly, for panning a light beam about a pan axis and tilting the light beam about a tilt axis, which is perpendicular to the pan axis, the assembly comprising:

an assembly housing;

a light source producing a controllable light beam in a direction generally along a pan axis;

a first generally cylindrical body mounted for rotation about the pan axis and having a mirror mounted within it in the path of the light beam, to reflect the beam out of the first cylindrical body through a generally circular opening;

a second generally cylindrical body mounted in the circular opening for rotation about a tilt axis that is panned upon rotation of the first cylindrical body, the second cylindrical body having a second mirror mounted within it in the path of the light beam reflected from the first mirror, to reflect the beam out of the second cylindrical body at a desired tilt angle;

a first drive pulley rigidly coupled to the first cylindrical body;

a second drive pulley rigidly coupled to the second cylindrical body;

a pan-axis drive motor mounted on the assembly housing and having a pan-axis drive pulley;

a tilt-axis drive motor mounted on the assembly housing and having a tilt-axis drive pulley;

a pair of idler pulleys mounted on the first cylindrical body for rotation about an axis perpendicular to tilt and pan axes;

first and second rigidly connected drive pulleys mounted for rotation about the pan axis independently of the first cylindrical body;

a pan-axis drive belt coupling the pan-axis drive pulley to the first drive pulley to effect rotation of the first cylindrical body about the pan axis;

a first tilt-axis drive belt coupling the tilt-axis drive pulley to one of the rigidly connected drive pulleys;

a second tilt-axis drive belt coupling the other of the rigidly connected drive pulleys to the second drive pulley, wherein the idler pulleys are employed to effect a ninety-degree change in orientation of the second tilt-axis drive belt as it passes from the rigidly connected drive pulley to the second drive pulley; and control means coupled to the pan-axis and tilt-axis motors, including means for providing a compensating control signal to the tilt-axis drive motor, to maintain a desired angular position with respect to the tilt axis during angular movements about the pan axis.

* * * * *